US010647109B2

(12) United States Patent
Takeuchi et al.

(10) Patent No.: US 10,647,109 B2
(45) Date of Patent: May 12, 2020

(54) PRINTING APPARATUS AND PRINTING CONTROL APPARATUS

(71) Applicant: SEIKO EPSON CORPORATION, Tokyo (JP)

(72) Inventors: Yasutoshi Takeuchi, Nagano (JP); Masaya Usui, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/112,920

(22) Filed: Aug. 27, 2018

(65) Prior Publication Data

US 2019/0061340 A1 Feb. 28, 2019

(30) Foreign Application Priority Data

Aug. 29, 2017 (JP) ..... 2017-164038

(51) Int. Cl.

| | |
|---|---|
| ***B41J 2/045*** | (2006.01) |
| ***B41J 2/21*** | (2006.01) |
| ***B41J 3/01*** | (2006.01) |
| ***B41J 19/14*** | (2006.01) |

(52) U.S. Cl.

CPC ..... *B41J 2/04508* (2013.01); *B41J 2/04586* (2013.01); *B41J 2/2103* (2013.01); *B41J 3/01* (2013.01); *B41J 19/142* (2013.01); *B41J 19/145* (2013.01)

(58) Field of Classification Search

CPC .. B41J 2/04508; B41J 2/04586; B41J 2/2103; B41J 3/01; B41J 19/142; B41J 19/145; G03F 1/0023

See application file for complete search history.

(56) References Cited

U.S. PATENT DOCUMENTS

| | | | | |
|---|---|---|---|---|
| 6,530,635 | B2 * | 3/2003 | Otsuki | B41J 19/142 347/12 |
| 8,668,309 | B2 * | 3/2014 | Usuda | B41J 2/2114 347/14 |
| 8,794,523 | B2 * | 8/2014 | Hoshino | H04N 1/00363 235/462.01 |
| 8,797,591 | B2 * | 8/2014 | Hosaka | B41J 3/01 358/1.4 |
| 2009/0251503 | A1 | 10/2009 | Kashimoto | |

FOREIGN PATENT DOCUMENTS

| | | |
|---|---|---|
| JP | 2005-047168 A | 2/2005 |
| JP | 2009-234071 A | 10/2009 |

* cited by examiner

*Primary Examiner* — Thinh H Nguyen
(74) *Attorney, Agent, or Firm* — Global IP Counselors, LLP

(57) ABSTRACT

A printing apparatus including a code information detecting unit configured to detect code information in image data, and a printing controller configured to control bidirectional printing to repeat a first scan including ink ejection in accordance with movement of a printing head to a first side in a main scanning direction, a second scan including ink ejection in accordance with movement of the printing head to a second side in the main scanning direction, and medium transport performed between the first scan and the second scan. The printing controller is configured to perform printing by any one of the first scan or the second scan in an area of the code information detected by the code information detecting unit, during the bidirectional printing based on the image data.

8 Claims, 8 Drawing Sheets

| PASS NO. | 1 | 2 | 3 | 4 |
|---|---|---|---|---|
| ORIENTATION | →S1 | S2← | →S1 | S2← |

PRINTING APPARATUS AND PRINTING CONTROL APPARATUS

The present application is based on and claims priority from JP Application Serial Number 2017-164038, filed Aug. 29, 2017, the disclosure of which is hereby incorporated by reference herein in its entirety.

BACKGROUND

1. Technical Field

The disclosure relates to a printing apparatus and a printing control apparatus.

2. Related Art

Bidirectional printing is known and the bidirectional printing includes ejecting droplets (dots) by a bidirectional scan of a printing head and causing the droplets to land on a medium to perform printing.

In the related art, there is known an ink jet recording apparatus configured to verify the absence or presence of code information in data to be recorded by a next recording scan, and configured to perform unidirectional recording when the code information is present in the data, and perform bidirectional recording when the code information is absent in the data (see JP-A-2005-47168).

In the bidirectional printing, landing positions of the dots ejected in correspondence to specific positions by movement (scan) in an outward path direction of the printing head, and landing positions of the dots ejected in correspondence to the specific positions by movement (scan) in a return path direction may be displaced from each other in the movement directions. When code information is subjected to printing, such displacement of the landing positions of the dots may excessively increase the thicknesses of individual bars constituting a code or make the individual bars uneven, and quality of the code may decrease. The code having decreased quality may result in a reading failure when the code is read.

In JP-A-2005-47168, when the code information is present in the data to be recorded by the next recording scan, the unidirectional recording (unidirectional printing) is performed. However, the unidirectional recording is a recording method including transporting a medium once for each single reciprocation of the printing head, and thus, printing time increases (a printing speed decreases).

SUMMARY

The disclosure provides a printing apparatus and a printing control apparatus useful for both improving quality of code information and suppressing an increase in printing time.

One aspect of the disclosure is a printing apparatus configured to perform a scan along a predetermined main scanning direction of a printing head including a plurality of nozzles configured to eject ink, and perform medium transport including relative movement of the printing head and a printing medium along a predetermined sub scanning direction intersecting the main scanning direction to perform printing. The printing apparatus includes a code information detecting unit configured to detect code information in image data, and a printing controller configured to control bidirectional printing to repeat a first scan including ink ejection in accordance with movement of the printing head to a first side in the main scanning direction, a second scan including ink ejection in accordance with movement of the printing head to a second side in the main scanning direction, and the medium transport performed between the first scan and the second scan. The printing controller is configured to perform printing by any one of the first scan or the second scan in an area of the code information detected by the code information detecting unit, during the bidirectional printing based on the image data.

According to the above-described configuration, while the printing apparatus maintains an operation of the bidirectional printing, the printing apparatus performs printing by any one of the first scan or the second scan in the area of the code information in the image data. Thus, in comparison to the related art in which unidirectional recording (unidirectional printing) is performed when code information is present in data to be recorded, printing time does not increase and quality of a code can be improved.

In one aspect of the disclosure, the printing controller may be configured to subject first raster data of raster data constituting the image data to printing by the first scan, and subject second raster data adjacent to the first raster data of the raster data to printing by the second scan, and the printing controller may be configured to subject any one of the first raster data or the second raster data to printing in the area of the code information in the image data.

According to the above-described configuration, the printing apparatus subjects any one of the first raster data associated with the first scan or the second raster data associated with the second scan to printing in the area of the code information, and does not subject the other to printing in the area of the code information. Accordingly, while an operation of the bidirectional printing is maintained, printing can be performed by any one of the first scan or the second scan in the area of the code information.

In one aspect of the disclosure, the printing controller may be configured to generate from the image data half tone data defining formation and non-formation of dots for each of pixels, and when the printing controller subjects the first raster data constituting the half tone data to printing by the first scan and subjects the second raster data constituting the half tone data to printing by the second scan, the printing controller may allow the formation of the dots for the pixels in any one of the first raster data or the second raster data and may prohibit the formation of the dots for the pixels in the other to generate the half tone data.

According to the above-described configuration, the printing apparatus is capable of generating the half tone data to perform printing by any one of the first scan or the second scan in the area of the code information and not to perform printing by the other in the area of the code information.

In one aspect of the disclosure, the printing controller may perform printing in the area of the code information at a print resolution lower than in an area other than the area of the code information of the image data.

According to the above-described configuration, the dots relatively sparse in the area of the code information can result in suppressing an increase in the thicknesses of individual bars constituting a code and the like and improving quality of the code.

The technical concepts of the disclosure are also realized in an aspect other than the printing apparatus. For example, a printing control apparatus configured to control the printing apparatus (a printing unit) and including the code information detecting unit and the printing controller configured to control the printing unit is conceivable. Furthermore, a method (a printing method, or a printing control method) including processing steps performed by the printing apparatus or the printing control apparatus, a program for causing a computer to perform the method, and a non-transitory computer-readable storage medium storing the program are each also considered to be the disclosure.

BRIEF DESCRIPTION OF THE DRAWINGS

Embodiments of the disclosure will be described with reference to the accompanying drawings, wherein like numbers reference like elements.

DESCRIPTION OF EXEMPLARY EMBODIMENTS

Exemplary embodiments of the disclosure will be described below with reference to the drawings. The respective drawings merely illustrate examples to describe some exemplary embodiments. Furthermore, the respective drawings may not conform with each other.

1. BRIEF DESCRIPTION OF APPARATUS CONFIGURATION

Figure 1:
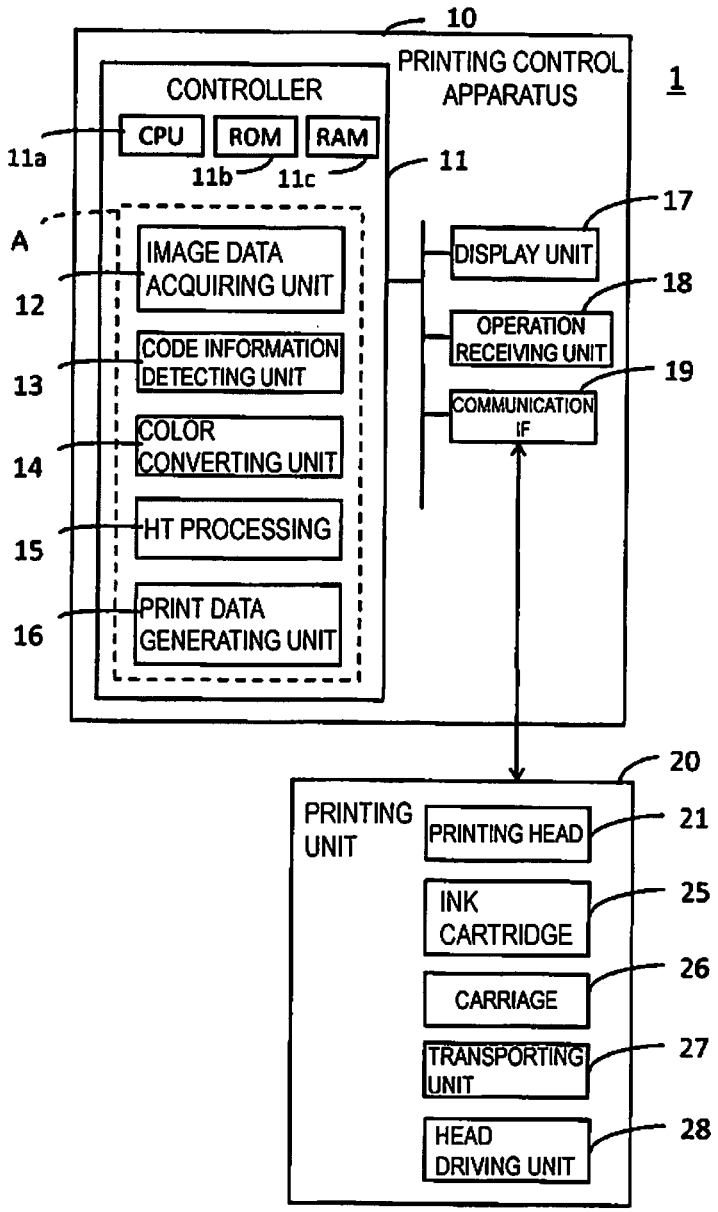
FIG. 1 is a view simply illustrating an apparatus configuration.

FIG. 1 simply illustrates an apparatus configuration according to one exemplary embodiment. A printing control apparatus 10 includes, for example, a controller 11, a display unit 17, an operation receiving unit 18, and a communication interface (IF) 19. The printing control apparatus 10 is realized, for example, by a personal computer (PC), or by an information processing device having the same degree of processing capability as processing capability of the PC. Furthermore, hardware capable of realizing the controller 11 according to one exemplary embodiment may also be referred to as the printing control apparatus.

The controller 11 includes at least one IC including a CPU 11*a*, a ROM 11*b*, a RAM 11*c*, and the like, another storage medium such as a memory and a hard disk drive, and the like as appropriate. In the controller 11, the CPU 11*a* performs arithmetic processing in accordance with a program stored in the ROM 11*b* and the like by using the RAM 11*c* and the like as a work area and accordingly controls behaviors of the printing control apparatus 10. A program A is installed in the controller 11, and the controller 11 realizes various functions such as an image data acquiring unit 12, a code information detecting unit 13, a color converting unit 14, a halftone (HT) processing unit 15, and a print data generating unit 16, in accordance with the program A. The program A can be referred to as a print control program, an image processing program, a printer driver, or the like. Furthermore, the controller 11 can be referred to as a printing controller.

The communication IF 19 is generally an IF through which the controller 11 performs communication with the outside of the printing control apparatus 10 in conformance with a specific communication standard. The display unit 17 is a device configured to display visual information, and includes, for example, a liquid crystal display (LCD), and an organic EL display. The display unit 17 may include a display and a drive circuit configured to drive the display. The operation receiving unit 18 is a device configured to receive an operation performed by a user, and is realized by physical buttons, a touch panel, a mouse, a keyboard, and the like. As a matter of course, the touch panel may be realized as a function of the display unit 17. Furthermore, the display unit 17 and the operation receiving unit 18 can be referred to collectively as an operation panel, or the like.

The printing control apparatus 10 is communicably coupled to the printing unit 20 via the communication IF 19. The printing unit 20 is a mechanism capable of executing printing based on print data, under control of the printing control apparatus 10 (the controller 11). The printing unit 20 includes a printing head 21, a carriage 26, a transporting unit 27, a head driving unit 28, and the like.

The printing control apparatus 10 and the printing unit 20 may be devices independent of each other. When the printing control apparatus 10 and the printing unit 20 are devices independent of each other, the printing unit 20 can be referred to as a printing apparatus, and a configuration including the printing control apparatus 10 and the printing unit 20 can be referred to as a printing system 1. The printing control apparatus 10 may be referred to as an image processing apparatus, or the like.

Alternatively, the printing control apparatus 10 and the printing unit 20 may be embodied as a single apparatus. When the printing control apparatus 10 and the printing unit 20 are embodied as a single apparatus, a configuration including the printing control apparatus 10 and the printing unit 20 (a single apparatus) can be referred to as a printing apparatus 1. The printing apparatus 1 has at least a printing function. Therefore, the printing apparatus 1 may be a multifunction apparatus having a plurality of functions such as a scanning function, and a facsimile function, in addition to the printing function.

Figure 2:
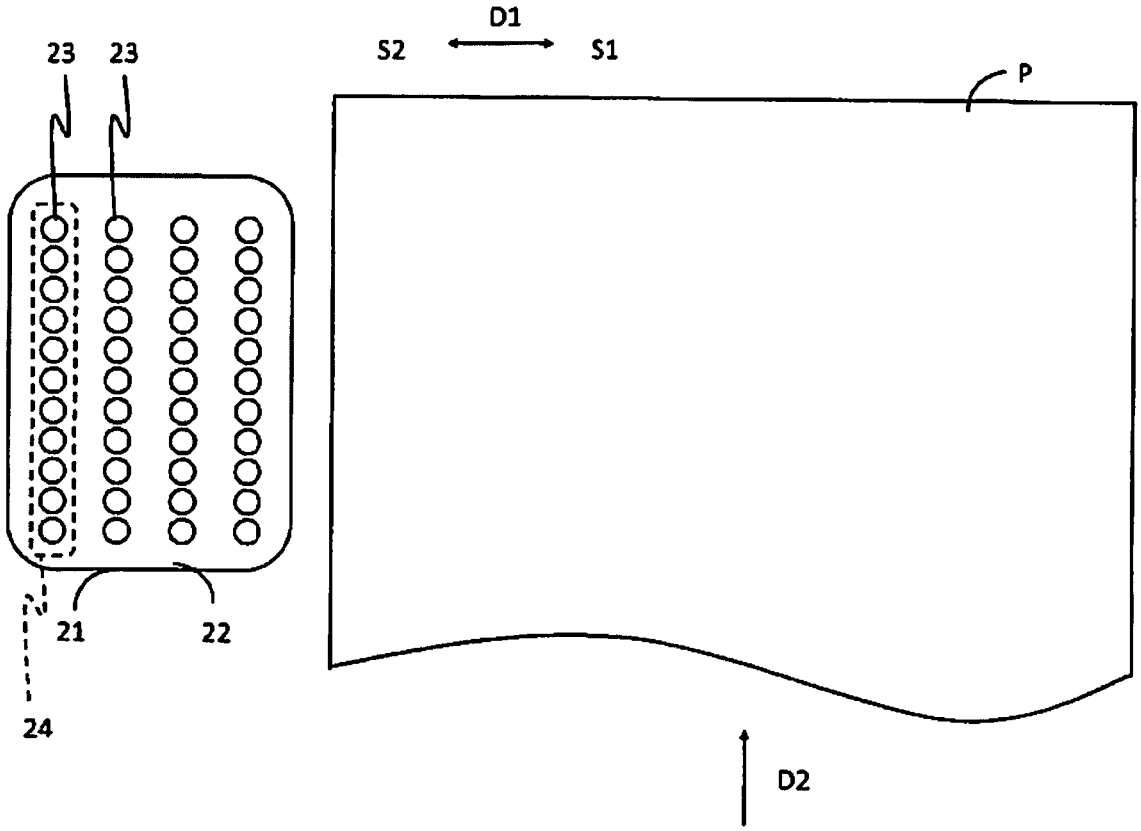
FIG. 2 is a view simply illustrating a printing head and a printing medium.

FIG. 2 simply illustrates the printing head 21 and a printing medium P. The printing head 21 includes a plurality of nozzles 23 capable of ejecting a liquid such as ink. The printing head 21 can also be referred to as a recording head, a print head, a liquid ejecting (jet) head, and the like. The printing medium P is typically paper, but the printing medium P may be a material other than paper as long as the material is recordable by ejection of the liquid.

The printing head 21 is installed on the carriage 26, and the carriage 26 moves along a predetermined main scanning direction D1 to move the printing head 21 along the main scanning direction D1.

As is known, the transporting unit 27 includes a roller configured to transport the printing medium P, a motor and a gear train configured to rotate the roller, and the like as appropriate, and transports the printing medium P along a transport direction D2 intersecting the main scanning direction D1. Here, intersecting basically means being orthogonal. However, the directions D1 and D2 may not strictly be orthogonal to each other, for example owing to various tolerances in the printing unit 20 as a product. The transport direction D2 is also referred to as a sub scanning direction.

FIG. 2 illustrates a nozzle surface 22 on which the nozzles 23 are open, and FIG. 2 illustrates one example of arrangement of the nozzles 23 on the nozzle surface 22. The printing head 21 is supplied with ink of a plurality of colors (ink of a plurality of colors such as cyan (C), magenta (M), yellow (Y), and black (K)) from an ink holding device referred to as an ink cartridge (or ink tank) 25 or the like and mounted in the printing unit 20, and the printing head 21 ejects the ink from the nozzles 23. In this configuration, the printing head 21 includes a nozzle row 24 for each of the ink colors. The nozzle row 24 includes the plurality of nozzles 23 arranged at a certain interval (a nozzle pitch) along the transport direction D2. In the example illustrated in FIG. 2, the printing head 21 includes four nozzle rows 24, and is capable of ejecting the ink of four colors. As a matter of course, the arrangement of the nozzles 23 constituting the nozzle row 24 corresponding to the ink of one color is not limited to a single straight line as illustrated in FIG. 2, and for example, the nozzles 23 constituting the nozzle row 24 corresponding to the ink of one color may be arranged into a plurality of rows.

Based on the print data generated by the printing control apparatus 10 (the controller 11), the head driving unit 28 generates a drive signal used for driving a driving element (such as a piezoelectric element) provided in correspondence to each of the nozzles 23 of the printing head 21, and outputs the drive signal to the printing head 21. In the printing head 21, the drive signal is applied to the driving element, and accordingly, the liquid (droplets) is ejected from each nozzle 23 corresponding to the driving element. The printing unit 20 repeats the transport of the printing medium P performed by the transporting unit 27, and the liquid ejection (scan) performed by the printing head 21 in accordance with the movement of the printing head 21 by the carriage 26, under control of the printing control apparatus 10 (the controller 11). Accordingly, the printing unit 20 performs printing on the printing medium P.

The scan of the printing head 21 is also referred to as a pass. The printing unit 20 (or a configuration 1 including the printing unit 20) can be referred to as an ink jet printer. The droplets ejected from the nozzles 23 by the printing head 21 are referred to as dots. However, in one exemplary embodiment, the term dot is also used for convenience when image processing or printing control processing at a stage preceding the ejection of the dots is described.

The printing unit 20 is capable of executing any one of unidirectional printing or bidirectional printing, depending on an instruction from the controller 11. The unidirectional printing refers to a recording method including executing ink ejection during any one of movement of the printing head 21 to a first side S1 in the main scanning direction D1, or movement of the printing head 21 to a second side S2 in the main scanning direction D1 (namely, a single reciprocation of the printing head 21), and transporting the printing medium P by a predetermined distance once for each single reciprocation of the printing head 21. In contrast to this, the bidirectional printing refers to a recording method including executing ink ejection during both movement of the printing head 21 to the first side S1 and movement of the printing head 21 to the second side S2, and transporting the printing medium P by a predetermined distance once after each of the movement to the first side S1 and the movement to the second side S2. The number of times of the transport with respect to the number of times of movement of the printing head 21 is greater in the bidirectional printing than in the unidirectional printing, and thus, total printing time taken for printing on the printing medium P having the same area reduces in the bidirectional printing.

Some exemplary embodiments will be described assuming that the controller 11 causes the printing unit 20 to perform the bidirectional printing. Furthermore, for convenience, in the bidirectional printing, the ink ejection in accordance with the movement of the printing head 21 to the first side S1 in the main scanning direction D1 will be referred to as a first scan, and the ink ejection in accordance with the movement of the printing head 21 to the second side S2 in the main scanning direction D1 will be referred to as a second scan. More specifically, the first scan may also be referred to as an outward path pass, and the second scan may also be referred to as a return path pass. However, in some exemplary embodiments, any of the first scan or the second scan may be considered as the outward path or the return path of the reciprocal operation of the printing head 21.

2. PRINTING CONTROL PROCESSING

Figure 3:
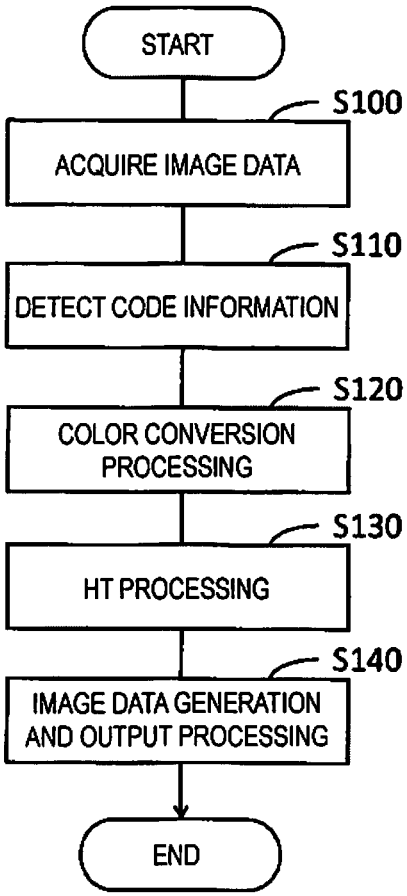
FIG. 3 is a flowchart illustrating processing performed by a controller in accordance with a program A.

FIG. 3 illustrates a flowchart of processing performed by the controller 11 in accordance with the program A.

The controller 11 (the image data acquiring unit 12) acquires image data representing a print target (step S100). Examples of the print target include a character, a photograph, CG, and a combination thereof. For example, a user operates the operation receiving unit 18 to select the image data. The image data acquiring unit 12 acquires the selected image data from a storage source. Examples of the storage source of the image data include a storage medium incorporated in the printing control apparatus 10, and a storage medium coupled from outside to the printing control apparatus 10. The image data acquiring unit 12 subjects the acquired image data to processing following step S110. Hereinafter, with reference to FIG. 3 and the like, a term such as CMYK data, HT data, and print data is used in each situation, but any of these terms refers to data converted and generated based on the image data acquired at step S100, and thus, any of these terms refers to the image data representing the print target.

At step S110, the controller 11 (the code information detecting unit 13) detects code information present in the image data, and stores a detection result. A method of detecting the code information varies in some exemplary embodiments. For example, the code information detecting unit 13 performs detection of a specific pattern (a pattern including black and white having predetermined widths or more and repeatedly appearing in a certain direction) in the image data rendered (drawn), and accordingly, the code information detecting unit 13 detects the predetermined pattern, namely, an area of the code information (a code information area).

Alternatively, the code information area may be specified by a user. Specifically, the code information detecting unit 13 causes the display unit 17 to display the image data rendered. When a user recognizes that the code information is present in the image data displayed by the display unit 17, the user operates the operation receiving unit 18 and accordingly, the user performs an operation such as encompassing with a rectangle the range in which the code information is present and specifies the range. The code information detecting unit 13 detects the range thus specified by the user as the code information area. Alternatively, the code information detecting unit 13 may analyze the image data without being rendered, and extract predetermined information indicating the presence of the code information to detect the code information. An example of the predetermined information indicating the presence of the code information includes a so-called barcode font. The presence of the code information, namely, the code information area in the image is detected based on the barcode font embedded in the image data.

Note that, at step S110, when the detection of the code information from the image data is not successful, the controller 11 simply causes the printing unit 20 to generally perform the bidirectional printing based on the image data. Hereinafter, the processing will be described assuming that the detection of the code information is successful at step S110.

At step S120, the controller 11 (the color converting unit 14) performs color conversion processing on the image data. An example of the image data that is a processing target at step S120 includes bitmap format RGB data having for each pixel gradation values (gradation values expressed in 256 gradations from 0 to 255, for example) for each of RGB (red, green, blue). The image data acquiring unit 12 or the code information detecting unit 13 performs format conversion or resolution conversion of the image data as appropriate, and then subjects the image data to step S120. The color conversion processing is processing to convert the image data (the RGB data) to data (the CMYK data) of a color space of ink used for printing by the printing unit 12. As is known, the color converting unit 14 is capable of referring to a table in which the RGB gradation values and the CMYK gradation values are associated with each other (a color conversion look-up table) and executing the color conversion processing. The image data (the CMYK data) having subjected to the color conversion processing is bitmap format data having for each pixel gradation values (gradation values expressed in 256 gradations from 0 to 255, for example) for each of CMYK.

At step S130, the controller 11 (the HT processing unit 15) performs HT processing for each ink color (CMYK) on the image data having subjected to the color conversion processing. The HT processing is performed by using a dither method, y correction, an error diffusion method, or the like. The image data having subjected to the HT processing is also referred to as HT data. The HT data is data for each of the ink colors, and defines formation or non-formation of the dots for each of the pixels. Note that the printing head 21 may be capable of ejecting the dots varying in size and in a liquid amount per droplet. For example, the printing head 21 is capable of ejecting three types of the dots varying in size (large dots, medium dots, small dots) from each of the nozzles 23. When the printing head 21 is capable of ejecting the dots varying in size, the HT processing unit 15 generates the HT data that is data for each of the ink colors, and that defines the absence or presence of the dots and the sizes of the dots for each pixel.

At step S140, the controller 11 (the print data generating unit 16) generates the print data used for printing by the printing unit 20, based on the HT data for each of the ink colors (CMYK), and outputs the generated print data to the printing unit 20. In other words, the print data generating unit 16 allocates the pixels aligned in a matrix shape and constituting the HT data to each of the nozzles 23 of the nozzle row 24 of the corresponding ink color, in accordance with the recording method having already been set (specified by a user, for example) at the start of the processing in the flowchart (FIG. 3), and realigns the pixels in the data order to be transferred. Such realignment is also referred to as rasterization and the rasterized data is referred to as the print data. The recording method refers to, for example, a method including various conditions combined such as any one of the unidirectional printing or the bidirectional printing to be performed, overlap printing to be performed or not, and a transportation amount between passes. The recording method determines which of the pixel data is allocated to which of the nozzles 23 for which of the passes and in which order. The recording method is a recording method corresponding to one type of the bidirectional printing in one exemplary embodiment.

The print data generating unit 16 adds a command specifying the recording method to the rasterized print data. The print data generating unit 16 outputs (transfers) the print data generated through the above-described processing to the printing unit 20 via the communication IF 19. The printing unit 20 performs printing based on the print data thus output. As a result, the print target represented by the image data acquired at step S100 is reproduced on the printing medium P.

In some exemplary embodiments, while the printing unit 20 performs the bidirectional printing based on the image data (the print data), the controller 11 performs printing by any one of the first scan or the second scan in the code information area. Steps S130 and 5140 at which such bidirectional printing including special printing in the code information area is realized will be described below.

3. FIRST EXEMPLARY EMBODIMENT

Figure 4:
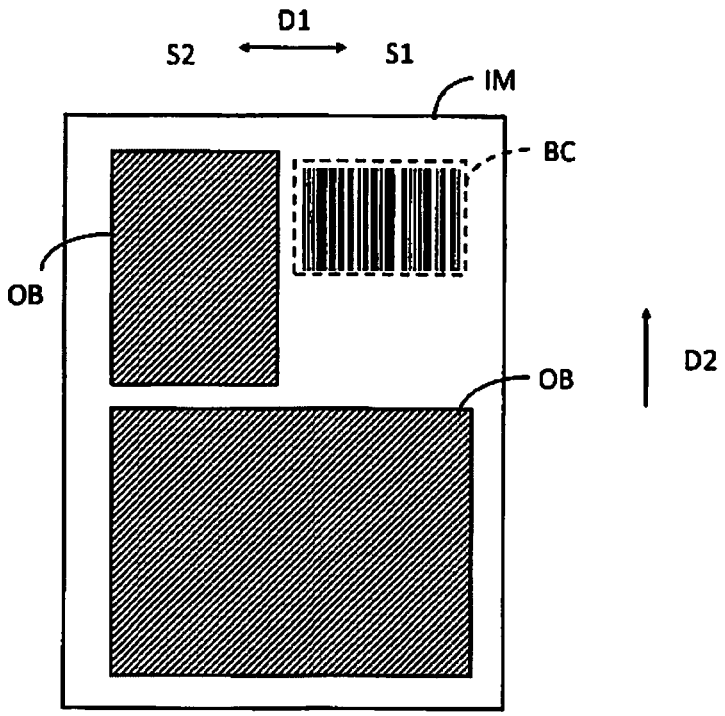
FIG. 4 is a view illustrating an example of image data.

FIG. 4 illustrates an example of one page of image data IM. FIG. 4 (and FIGS. 6, 7, and 8 below) illustrates an orientation of the image data, together with a correspondence relationship between and a main scanning direction D1 and a transport direction D2 at the time of printing. The image data IM includes various print targets (objects OB) in an area of the image data IM. FIG. 4 illustrates one of these objects OB, and code information (a code information area) detected at step S110.

In a First Exemplary Embodiment, at step S130, a controller 11 (an HT processing unit 15) performs HT processing by a dither method using dither masks on the image data having subjected to color conversion processing. In this case, the HT processing unit 15 applies different dither masks in a code information area BC detected at step S110 of the image data IM, and in an area other than the code information area BC. The dither mask applied in the area other than the code information area BC of the image data IM is referred to as a first dither mask. Meanwhile, the dither mask applied in the code information area BC of the image data IM is referred to as a second dither mask.

Figure 5A:
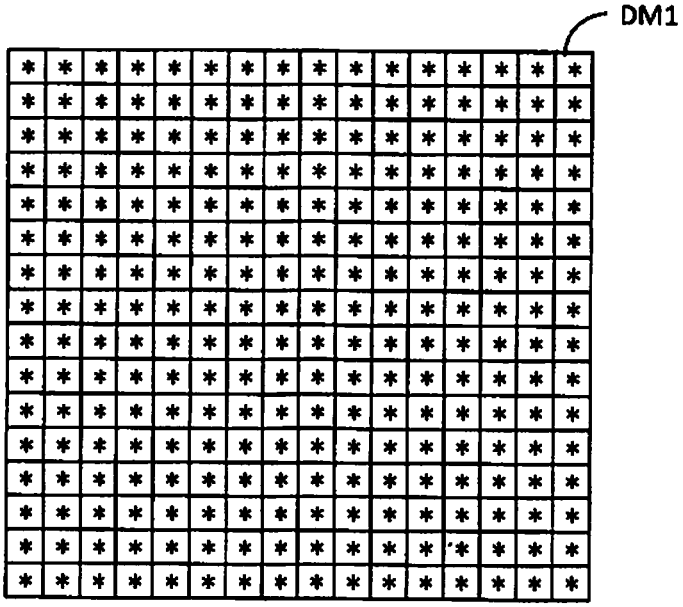
FIG. 5A is a view illustrating an example of a first dither mask.
Figure 5B:
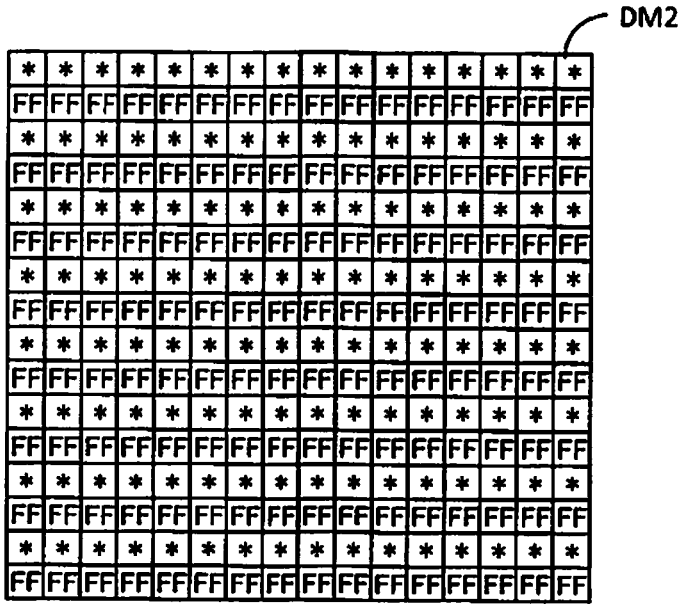
FIG. 5B is a view illustrating an example of a second dither mask.

FIG. 5A illustrates an example of the first dither mask (a dither mask DM1), and FIG. 5B illustrates an example of the second dither mask (a dither mask DM2). The dither mask DM1 is a mask in which threshold values used in the HT processing (gradation values from 0 to 255, for example) are arranged in a matrix shape. An asterisk "*" noted in each of rectangles constituting the dither mask DM1 indicates any threshold value. Similarly, the dither mask DM2 is a mask in which threshold values used in the HT processing are arranged in a matrix shape. The arrangement of predetermined threshold values entering the asterisks "*" respectively in the dither masks DM1 and DM2 is not limited here. As is known, in the HT processing, when the dither mask is applied to the image data, dot-on (dot formation) is defined for a pixel having a gradation value higher than a threshold value at a corresponding position in the dither mask, and dot-off (dot non-formation) is defined for a pixel having a gradation value equal to or lower than a threshold value at a corresponding position in the dither mask.

Here, in the dither mask DM2, alternate rows of the threshold values are fixed at a maximum value (255). In FIG. 5B, the maximum value threshold value of 255 is expressed by "FF." In other words, as in FIG. 5B, in the dither mask DM2, the alternate rows in the horizontal direction of the threshold values are set at FF. Therefore, the dither mask DM2 is applied in the code information area BC at step S130, and accordingly, HT data generated is data in which alternate rows of pixels (pixel rows oriented in the main scanning direction D1 at the time of printing) are defined as dot-off. The controller 11 stores such different dither masks DM1 and DM2 in advance, and uses the dither masks DM1 and DM2 at step S130. Alternatively, the controller 11 may store the dither mask DM1 in advance, and when the dither mask DM2 is to be used (at step S130), the controller 11 may process the dither mask DM1 to generate the dither mask DM2 as illustrated in FIG. 5B, and use the dither masks DM1 and DM2.

Figure 6:
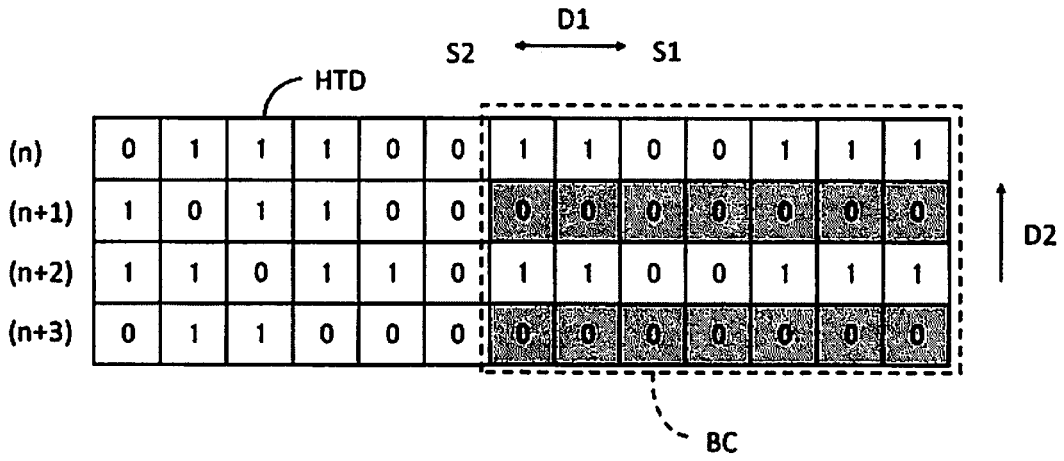
FIG. 6 is a view illustrating an example of HTD including a code information area.

FIG. 6 illustrates a part of the HT data (HTD) for one of the ink colors (K, for example) generated at step S130, and illustrates an example of the range including a part of the code information area BC. Each of rectangles constituting the HTD is each of pixels of the HTD. In FIG. 6, "1" means dot-on, and "0" means dot-off for each of the pixels. The dither mask DM1 is applied in the area other than the code information area BC of the HTD, and accordingly, dot-on "1" or dot-off "0" is defined for each of the pixels according to the gradation value that each of the pixels originally has.

Meanwhile, the dither mask DM2 is applied in the code information area BC of the HTD, and accordingly, the alternate rows of the pixels are defined as dot-off "0". In FIG. 6, the pixels thus defined as dot-off regardless of the original gradation values are colored in gray to be easy to identify. As a matter of course, the dither mask DM2 is applied in the code information area BC, and accordingly, the pixels other than the pixels colored in gray in the code information area BC are defined as dot-on "1" or dot-off "0" according to the gradation value that each of the pixels originally has. Here, "1" defined for the pixels in the code information area BC corresponds to the dots used for reproducing individual bars constituting the code information.

Furthermore, in FIG. 6, for convenience, a number in parentheses is given for each of the pixel rows constituting the image data. The pixel rows oriented in the main scanning direction D1 at the time of printing are referred to as raster data. In other words, FIG. 6 illustrates a part of each of n-th raster data, n+1st raster data, n+2nd raster data, n+3rd raster data, and so on as counting from a head of the page. Then, the pixels present in each of the alternate rows of the raster data (the n+1st raster data, the n+3rd raster data and so on, for example) and present in the code information area BC are defined as dot-off "0" by the application of the dither mask DM2 at step S130.

Figure 7:
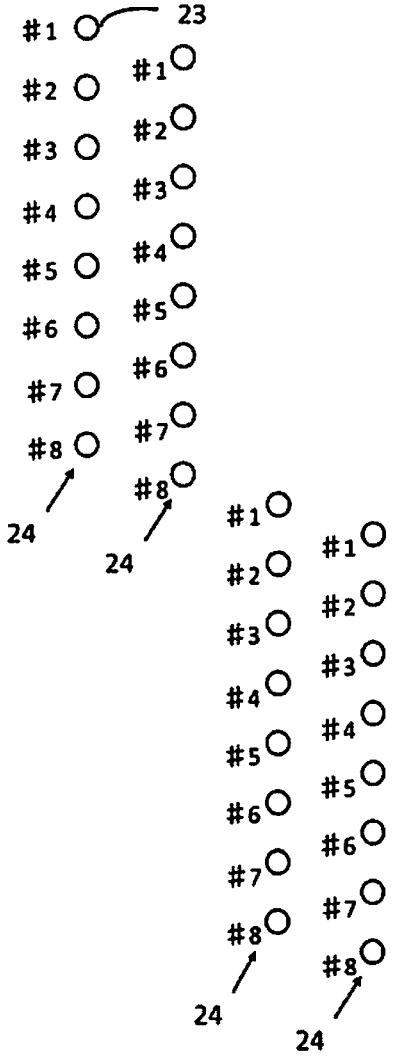
FIG. 7 is an explanatory view illustrating an example of an allocation relationship between nozzles and pixels of the HTD.
Figure 7:
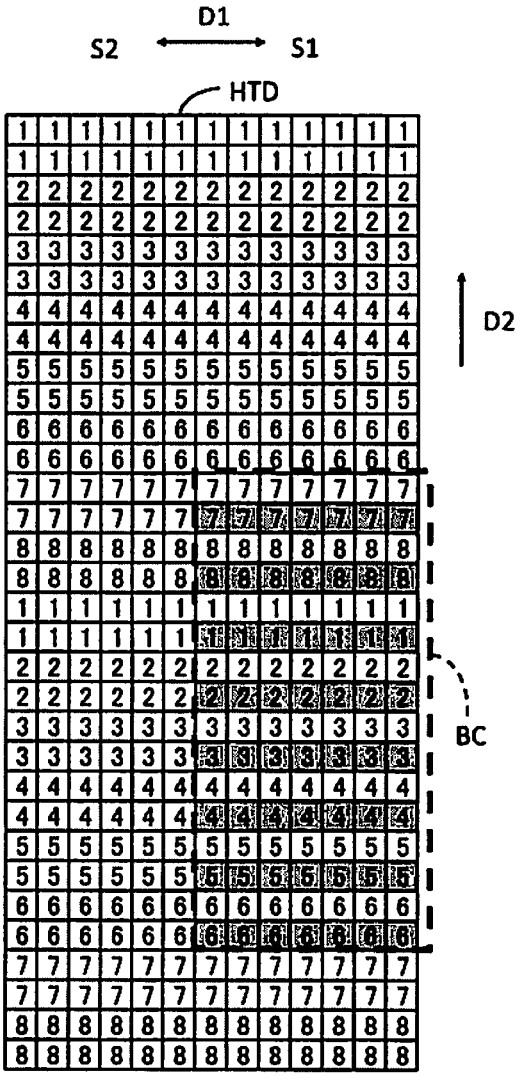

FIG. 7 is an explanatory view illustrating an allocation relationship between nozzles 23 constituting a nozzle row 24 for one of the ink colors (K, for example) and pixels constituting a part of the HT data (HTD) for the ink color. In FIG. 7, as one example, a total of the eight nozzles 23 constitute the nozzle row 24, and each of the nozzles 23 aligned at a certain nozzle pitch along the transport direction D2 is indicated by a circle. In FIG. 7, for convenience, numbers #1 to #8 are given as nozzle numbers for the respective nozzles 23 in order from a downstream side in the transport direction D2. However, the number of the nozzles 23 constituting the nozzle row 24 in an actual ink jet printer is significantly greater than eight.

Furthermore, FIG. 7 illustrates an orientation of movement of a printing head 21 for each of passes of the printing head 21 (a first pass, a second pass, a third pass, a fourth pass, and so on), and occurrence of a relative positional change between the nozzle row 24 and the HTD for each pass. Here, each of the first pass, the third pass, and so on corresponds to a pass by movement of the printing head 21 to a first side S1 in the main scanning direction D1, namely, a first scan. Furthermore, each of the second pass, the fourth pass, and so on corresponds to a pass by movement of the printing head 21 to a second side S2 in the main scanning direction D1, namely, a second scan. Note that the printing head 21 does not actually move in the transport direction D2, but a transporting unit 27 transports a printing medium P before and after each pass, and accordingly, such a relative positional change appears on the printing medium P as a printing result.

Similarly, in FIG. 7, each of rectangles constituting the HTD is each of the pixels of the HTD. Furthermore, in FIG. 7, a number (any of 1 to 8) given for each of the pixels refers to a nozzle number of the nozzle 23 to which the pixel is allocated (in other words, the number does not indicate dot-on or dot-off). Similarly, in FIG. 7, the pixel rows including the pixels aligned in the horizontal direction (the main scanning direction D1) corresponds to one piece of raster data (a part of the one piece of the raster data). In the example in FIG. 7, the pixels present in the same raster data are allocated to the same nozzle 23.

Such an allocation relationship between the nozzles 23 and the pixels as illustrated in FIG. 7 indicates pseudo band printing (or micro-feed printing) as a recording method. The pseudo band printing itself is known and a detailed description of the pseudo band printing is omitted here, but the pseudo band printing refers to a recording method including subjecting an image area called a pseudo band to printing by a plurality of passes between which transport by a distance smaller than a nozzle pitch (micro-feed) is performed, and then executing transport (paper feed) to print the next pseudo band. According to the example in FIG. 7, it can be understood that a cycle of "the first scan→the micro-feed corresponding to the distance half the nozzle pitch→the second scan→the paper feed to print the next pseudo band" is repeated. Thus, a resolution in the transport direction D2 of the HTD is twice a resolution (a nozzle resolution) in the transport direction D2 of the nozzles 23 in the nozzle row 24. For example, the controller 11 performs resolution conversion on the image data before step S120, to make the resolution in the transport direction D2 twice the nozzle resolution.

As described above, at step S140, the controller 11 (a print data generating unit 16) allocates the pixels constituting the HT data to each of the nozzles 23 in the nozzle row 24 for each pass, in accordance with the recording method. According to the example of the pseudo band printing illustrated in FIG. 7, the raster data constituting the HTD and aligned in the transport direction D2 is alternately allocated to the first scan and the second scan. In the First Exemplary Embodiment, the raster data to be subjected to printing by the first scan is referred to as first raster data, and the raster data to be subjected to printing by the second scan is referred to as second raster data. Therefore, according to the example in FIG. 7, the first raster data and the second raster data are alternately present in the HTD (the second raster data is adjacent to the first raster data). In this case, the raster data partially corresponding to the code information area BC (the n-th raster data to the n+3rd raster data illustrated in FIG. 6, for example) is also alternately allocated to the first scan and the second scan.

As with FIG. 6, in FIG. 7, alternate rows of pixel groups defined as dot-off "0" by applying the dither mask DM2 in the code information area BC are colored in gray. In the example in FIG. 7, the alternate rows of the raster data including the pixels colored in gray are allocated to the second scan, and thus, the alternate rows of the raster data including the pixels colored in gray correspond to the second raster data. Therefore, according to the allocation example in FIG. 7, as a result of step S140, an image represented by the image data (the print data) is printed by the printing unit 20 by the first scan and the second scan, namely, by the bidirectional printing. However, while movement in the bidirectional printing is maintained, printing by any one of the first scan or the second scan (here, the first scan) is exceptionally performed in the code information area BC.

The recording method that the controller 11 causes the printing unit 20 to perform is not limited to the pseudo band printing as illustrated in FIG. 7. For example, the controller 11 is capable of adopting a recording method including subjecting each of the alternate rows of the raster data (the first raster data) constituting the image data to printing by two first scans, and similarly subjecting each of the alternate rows of the raster data (the second raster data) other than the first raster data to printing by two second scans.

Figure 8:
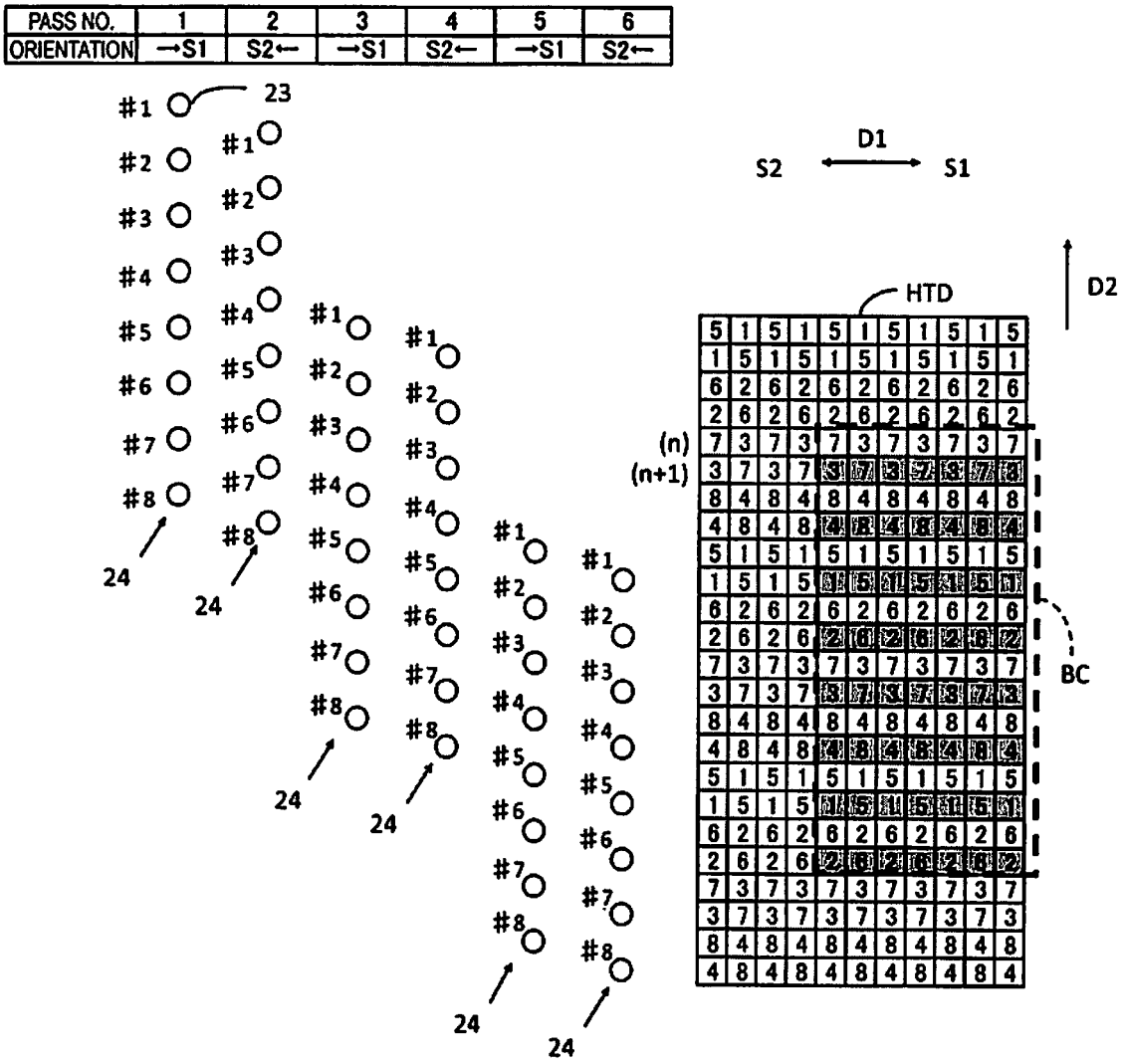
FIG. 8 is an explanatory view illustrating another example of the allocation relationship between the nozzles and the pixels of the HTD.

FIG. 8 is an explanatory view illustrating an allocation relationship between the nozzles 23 constituting the nozzle row 24 for one of the ink colors (K, for example) and the pixels constituting a part of the HT data (HTD) for the ink color, and illustrates an example different from the example in FIG. 7. FIG. 8 is illustrated in the same manner as FIG. 7. Similarly, in FIG. 8, each of the first pass, the third pass, the fifth pass, and so on corresponds to the first scan, and each of the second pass, the fourth pass, the sixth pass, and so on corresponds to the second scan.

In the example in FIG. 8, approximately half of the pixels present in the same raster data are allocated to one of the nozzles 23 for one pass, and the other half of the pixels are allocated to another of the nozzles 23 for another pass. For example, in the n-th raster data, respective pixels of alternate pixels are allocated to the nozzle 23 of the nozzle number #7 for the first pass, and the remaining alternate pixels are allocated to the nozzle 23 of the nozzle number #3 for the third pass. Furthermore, in the next n+1st raster data, respective pixels of alternate pixels are allocated to the nozzle 23 of the nozzle number #7 for the second pass, and the remaining alternate pixels are allocated to the nozzle 23 of the nozzle number #3 for the fourth pass.

In other words, similarly, according to the example in FIG. 8, the raster data constituting the HTD and aligned in the transport direction D2 is alternately allocated to the first scan and the second scan (the first raster data and the second raster data are alternately present). As with FIG. 6 and FIG. 7, in FIG. 8, the alternate rows of the pixel groups defined as dot-off "0" by applying the dither mask DM2 in the code information area BC are colored in gray. Similarly, in the example in FIG. 8, the alternate rows of the raster data including the pixels colored in gray (the n+1st raster data, for example) are allocated to the second scan. Therefore, according to the allocation example in FIG. 8, as a result of step S140, while an image represented by the image data (the print data) is printed by the printing unit 20 by the bidirectional printing, printing by any one of the first scan or the second scan (here, the first scan) is exceptionally performed in the code information area BC.

4. SECOND EXEMPLARY EMBODIMENT

The technique in which printing by any one of the first scan or the second scan is performed in the code information area while the printing unit 20 performs the bidirectional printing based on the image data (the print data) is not limited to the technique in which the dither masks DM1 and DM2 are used in the HT processing as in the First Exemplary Embodiment. A Second Exemplary Embodiment will be described below.

In the Second Exemplary Embodiment, at step S130, a controller 11 (an HT processing unit 15) performs HT processing on image data having subjected to color conversion processing without division between a code information area BC and an area other than the code information area BC (applying a dither mask DM1 entirely in the area of the image data, for example).

Next, at step S140, the controller 11 (a print data generating unit 16) allocates pixels constituting HT data to each of nozzles 23 of a nozzle row 24 for each pass, in accordance with a recording method. In this case, the recording method (a recording method by bidirectional printing) has already been set, and thus, it can be determined in accordance with the recording method to which of a first scan and a second scan each of the pixels constituting the HT data is to be allocated. Thus, in the print data generating unit 16, the pixels that are present in the code information area BC detected at step S110 of the pixels constituting the HT data, and that are to be allocated, for example, to the second scan are defined as dot-off "0" and then are output as a part of print data to a printing unit 20. As a result of step S140, while an image represented by the image data (the print data) is printed by the printing unit 20 by the bidirectional printing, printing by any one of the first scan or the second scan (here, the first scan) is exceptionally performed in the code information area BC.

Depending on the recording method instructed to the printing unit 20 by the controller 11, raster data constituting the image data may not alternately correspond to first raster data subjected to printing by the first scan and second raster data subjected to printing by the second scan, as in the examples in FIGS. 7 and 8. However, according to the Second Exemplary Embodiment, regardless of arrangement of the first raster data subjected to printing by the first scan and the second raster data subjected to printing by the second scan, namely, regardless of the type of the recording method by bidirectional printing, the scan used in printing in the code information area BC can be limited to any one of the first scan or the second scan, in accordance with the recording method set at that time.

Note that, in the Second Exemplary Embodiment, a part of the processing performed by the controller 11 (the print data generating unit 16) at step S140 may be performed on the printing unit 20 side. In this case, the print data generating unit 16 outputs the print data generated in accordance with the recording method to the printing unit 20 (step S140) together with a detection result of the code information area BC at step S110. Then, the printing unit 20 defines as dot-off "0" the pixels that are present in the code information area BC of the data of the pixels sequentially input as the print data and that are to be allocated, for example, to the second scan in accordance with the recording method specified by the controller 11, and then the printing unit 20 performs printing in accordance with the print data. Similarly, according to such a configuration, while the printing unit 20 prints an image represented by the image data (the print data) by the bidirectional printing, printing by any one of the first scan or the second scan (here, the first scan) is exceptionally performed in the code information area BC.

5. ADDITIONAL NOTES

Thus, according to the Second Exemplary Embodiment, a printing apparatus 1 (or a printing control apparatus 10) performs a scan along a main scanning direction D1 of a printing head 21 including the plurality of nozzles 23 capable of ejecting ink, and medium transport including relative movement of the printing head 21 and a printing medium P along a sub scanning direction (a transport direction D2) intersecting the main scanning direction D1 to perform printing. Then, the printing apparatus 1 includes a code information detecting unit 13 configured to detect code information present in image data, and a printing controller (the controller 11) capable of controlling bidirectional printing to repeat a first scan including ink ejection in accordance with movement of the printing head 21 to a first side S1 in the main scanning direction D1, a second scan including ink ejection in accordance with movement of the printing head 21 to a second side S2 in the main scanning direction D1, and the medium transport performed between the first scan and the second scan. While the controller 11 (particularly, the HP processing unit 15 and the print data generating unit 16) performs (causes the printing unit 20 to perform) the bidirectional printing based on the image data, the controller 11 performs printing by any one of the first scan or the second scan in the code information area BC detected by the code information detecting unit 13.

According to the above-described configuration, while an operation of the bidirectional printing is maintained, printing is performed by any one of the first scan or the second scan in the code information area BC present in the image data. In other words, in contrast to the related art in which the bidirectional printing is switched to the unidirectional recording (the unidirectional printing) when code information is present in data for a pass to be recorded, such switching is not performed. Thus, the number of times of movement of the head with respect to the number of times of transport does not increase during printing of a page, and an increase in printing time is avoided. In addition, the code information is subjected to printing by any one of the first scan or the second scan, and thus, a decrease in quality due to displacement of landing positions of the dots that may occur in printing by both the first scan and the second scan is avoided.

Furthermore, according to the Second Exemplary Embodiment, the controller 11 subjects the first raster data of the raster data constituting the image data to printing by the first scan, and subjects the second raster data adjacent to the first raster data of the raster data to printing by the second scan, and the controller 11 subjects any one of the first raster data or the second raster data to printing in the code information area BC present in the image data. According to the above-described configuration, any one of the first raster data or the second raster data is actually subjected to printing in the code information area BC, and the other is not subjected to printing in the code information area BC. In this case, for example, even when the second raster data is not subjected to printing in the code information area BC, the pixels outside the code information area BC of the second raster data are subjected to printing as normal (see, for example, the n+1st raster data and the n+3rd raster data in FIG. 6). Accordingly, while an operation of the bidirectional printing by the printing unit 20 is maintained, printing is performed by any one of the first scan or the second scan in the code information area BC.

Furthermore, according to the Second Exemplary Embodiment, the controller 11 generates from the image data the HT data defining the formation and the non-formation of the dots for each of the pixels (step S130), and when the controller 11 subjects the first raster data constituting the HT data to printing by the first scan and subjects the second raster data constituting the HT data to printing by the second scan (step S140), the controller 11 allows the formation of the dots for the pixels present in any one of the first raster data or the second raster data and prohibits the formation of the dots for the pixels present in the other to generate the HT data. Namely, at step S130 in the First Exemplary Embodiment, the HT processing is performed by the dither method in which the dither mask DM2 (FIG. 5B) is applied in the code information area BC. According to the above-described configuration, during an operation of the bidirectional printing by the printing unit 20, the HT data is easily generated to realize the operation in which printing is performed by any one of the first scan or the second scan in the code information area BC and printing is not performed by the other in the code information area BC.

Furthermore, according to the Second Exemplary Embodiment, the controller 11 may perform printing in the area of the code information at a print resolution lower than in an area other than the code information area BC. Namely, as seen from FIGS. 6, 7, and 8, any one of the first raster data or the second raster data alternately present is subjected to printing in the code information area BC, and accordingly, a print resolution in the transport direction D2 results in half of a print resolution in the area other than the code information area BC where the first raster data and the second raster data are both subjected to printing. According to the above-described configuration, the dots relatively sparse in the code information area BC (the number of the dots aligned along the transport direction D2 to constitute individual bars of a code is approximately half of the number of the dots in the case of simply printing in accordance with the original image data) results in suppressing an increase in the thicknesses of the individual bars due to ink bleeding, and improving quality of the code.

Note that the Second Exemplary Embodiment copes with a decrease in quality of the code information (increased thicknesses, or unevenness of the bars) due to displacement of the landing positions of the dots in printing by both the first scan and the second scan (the bidirectional printing). From this point of view, when the orientation of the code information (the direction in which the bars are aligned) corresponds to the main scanning direction D1, the effects of the Second Exemplary Embodiment are particularly anticipated. Therefore, at step S110, the controller 11 (the code information detecting unit 13) may also determine based on the printing direction of the image data whether the orientation of the code information present in the image data corresponds to the main scanning direction D1. Then, when the code information (the code information area BC) having the orientation corresponding to the main scanning direction D1 is detected from the image data, the Second Exemplary Embodiment may be performed, and when the code information (the code information area BC) having the orientation corresponding to the main scanning direction D1 is not detected from the image data, the bidirectional printing may generally be performed based on the image data.

The orientation of the code information corresponding to the main scanning direction D1 refers to a state in which the orientation of the code information and the main scanning direction D1 are basically parallel to each other (see FIG. 4). However, the orientation of the code information and the main scanning direction D1 may not strictly be parallel to each other, and for example, when an angle formed between the orientation of the code information and the main scanning direction D1 is smaller than an angle formed between the orientation of the code information and the transport direction D2, the orientation of the code information may be determined to correspond to the main scanning direction D1.

In the Second Exemplary Embodiment, while the bidirectional printing is performed based on the image data, printing may also be performed by any one of the first scan or the second scan in the area other than the code information area. Namely, when a print target represented by the image data acquired at step S100 has a pale color, or when many blank areas are present in the image data, there may be a case where even when normal ink ejection is performed in accordance with the image data, the ink ejection results in ink ejection performed by any one of an outward path pass or a return path pass of the printing head 21. Meanwhile, in the Second Exemplary Embodiment, while the bidirectional printing is performed based on the image data, ink ejection is performed by any one of the first scan or the second scan in the code information area, even when the acquired image data includes the dots that are normally ejected by both the first scan and the second scan.

6. MODIFIED EXAMPLE

The disclosure is not limited to the above-described exemplary embodiments, and can include various modified examples as described below. Combinations of the above-described exemplary embodiments and the respective modified examples also fall within the scope of the disclosure.

While a printing unit 20 performs bidirectional printing based on image data (print data), the printing unit 20 performs printing by any one of a first scan or a second scan in a code information area, and may also adjust a dot size in the code information area. For example, in printing of code information, the size of each dot uniformly adjusted to a certain size leads to improvement in quality of the code information (suppressing the increased thicknesses, unevenness, bleeding, and the like of bars). Thus, a controller 11 (an HT processing unit 15 or a print data generating unit 16) adjusts the dot size in the code information area, at step S130 or step S140.

When a printing head 21 is configured to eject a plurality of types of dots having different sizes (large dots, medium dots, small dots, for example) from each of nozzles 23, information of dot-on "1" (see FIG. 6) for each of pixels of HT data is actually information meaning dot-on of any of the large dots, the medium dots, and the small dots. Thus, at step S130 in the First Exemplary Embodiment, when the HT processing unit 15 applies the dither mask DM2 (FIG. 5B) in the code information area BC of the image data and defines dot-on and dot-off in the code information area BC, the size of each dot occurring in the code information area BC is uniformly adjusted to a certain size (for example, the medium dots smaller than the largest dots).

Alternatively, at step S140 in the Second Exemplary Embodiment, the print data generating unit 16 defines as dot-off "0" the pixels that are present in the code information area BC as described above of the HT data generated by the HT processing, and that are to be allocated, for example, to the second scan. In this case, the print data generating unit 16 also uniformly adjust the size of each of the pixels defined as dot-on among the pixels that are present in the code information area BC and that are to be allocated to the first scan, to a certain size (the medium dots, for example).

According to the above-described modified example, when the bidirectional printing is performed based on the image data, the dots are made sparse (printing by any one of the first scan or the second scan) and are uniformly adjusted in size in the code information area BC, and accordingly, quality of a code is further enhanced.

Furthermore, in the disclosure, the medium transport including the relative movement of the printing head 21 and the printing medium P along the sub scanning direction intersecting the main scanning direction is not limited to the transport of the printing medium P itself. For example, the printing head 21 may move by a predetermined distance in the sub scanning direction after end of one pass and then may perform the next pass to realize the relative movement of the printing head 21 and the printing medium P along the sub scanning direction.

In some exemplary embodiments, the code information is assumed to be of a type of code capable of providing some kind of information when the code is read. Therefore, the code information also includes, in addition to a barcode, so-called two-dimensional code information. Accordingly, some exemplary embodiments are also applicable to the case where the code information detecting unit 13 detects the two-dimensional code information from the image data.

What is claimed is:

1. A printing apparatus configured to perform a scan along a predetermined main scanning direction of a printing head including a plurality of nozzles configured to eject ink of the same color, and perform medium transport including relative movement of the printing head and a printing medium along a predetermined sub scanning direction intersecting the main scanning direction to perform printing, the printing apparatus comprising:

a code information detecting unit configured to detect code information in image data; and a printing controller configured to control bidirectional printing to repeat a first scan including ink ejection in accordance with movement of the printing head to a first side in the main scanning direction, a second scan including ink ejection in accordance with movement of the printing head to a second side in the main scanning direction, and the medium transport performed between the first scan and the second scan, wherein the printing controller is configured to control the plurality of nozzles to perform the bidirectional printing based on the image data, without switching to a unidirectional printing, in an area of the code information detected by the code information detecting unit by performing printing by one of the first scan and the second scan and not performing printing by the other of the first scan and the second scan, and the printing controller is configured to control the plurality of nozzles to perform the bidirectional printing based on the image data in an area other than the area of the code information by performing printing by both of the first scan and the second scan.

2. The printing apparatus according to claim 1, wherein the printing controller is configured to subject first raster data of raster data constituting the image data to printing by the first scan, and subject second raster data adjacent to the first raster data of the raster data to printing by the second scan, and the printing controller is configured to subject any one of the first raster data or the second raster data to printing in the area of the code information in the image data.

3. The printing apparatus according to claim 2, wherein the printing controller is configured to generate from the image data half tone data defining formation and non-formation of dots for each of pixels, and when the printing controller subjects the first raster data constituting the half tone data to printing by the first scan and subjects the second raster data constituting the half tone data to printing by the second scan, the printing controller allows the formation of the dots for the pixels in any one of the first raster data or the second raster data and prohibits the formation of the dots for the pixels in the other to generate the half tone data.

4. The printing apparatus according to claim 1, wherein the printing controller is configured to perform printing in the area of the code information at a print resolution lower than in an area other than the area of the code information of the image data.

5. A printing apparatus configured to perform a scan along a predetermined main scanning direction of a printing head including a plurality of nozzles configured to eject ink, and perform medium transport including relative movement of the printing head and a printing medium along a predetermined sub scanning direction intersecting the main scanning direction to perform printing, the printing apparatus comprising:

a code information detecting unit configured to detect code information in image data; and a printing controller configured to control bidirectional printing to repeat a first scan including ink ejection in accordance with movement of the printing head to a first side in the main scanning direction, a second scan including ink ejection in accordance with movement of the printing head to a second side in the main scanning direction, and the medium transport performed between the first scan and the second scan, wherein the printing controller is configured to continue to perform the bidirectional printing based on the image data, without switching to a unidirectional printing, in an area of the code information detected by the code information detecting unit by performing printing at a first print resolution by one of the first scan and the second scan and not performing printing by the other of the first scan and the second scan, and the printing controller is configured to perform the bidirectional printing based on the image data in an area other than the area of the code information of the image data by performing printing at a second print resolution higher than the first print resolution by both of the first scan and the second scan.

6. The printing apparatus according to claim 5, wherein the printing controller is configured to subject first raster data of raster data constituting the image data to printing by the first scan, and subject second raster data adjacent to the first raster data of the raster data to printing by the second scan, and the printing controller is configured to subject any one of the first raster data or the second raster data to printing in the area of the code information in the image data.

7. The printing apparatus according to claim 6, wherein the printing controller is configured to generate from the image data half tone data defining formation and non-formation of dots for each of pixels, and when the printing controller subjects the first raster data constituting the half tone data to printing by the first scan and subjects the second raster data constituting the half tone data to printing by the second scan, the printing controller allows the formation of the dots for the pixels in any one of the first raster data or the second raster data and prohibits the formation of the dots for the pixels in the other to generate the half tone data.

8. A printing control apparatus configured to control a printing unit to perform a scan along a predetermined main scanning direction of a printing head including a plurality of nozzles configured to eject ink of the same color, and perform medium transport including relative movement of the printing head and a printing medium along a predetermined sub scanning direction intersecting the main scanning direction to perform printing, the printing control apparatus including:

a code information detecting unit configured to detect code information in image data; and a printing controller configured to control bidirectional printing to repeat a first scan including ink ejection in accordance with movement of the printing head to a first side in the main scanning direction, a second scan including ink ejection in accordance with movement of the printing head to a second side in the main scanning direction, and the medium transport performed between the first scan and the second scan, wherein the printing controller is configured to cause the plurality of nozzles to perform the bidirectional printing based on the image data, without switching to a unidirectional printing, in an area of the code information detected by the code information detecting unit by performing printing by one of the first scan and the second scan and not performing printing by the other of the first scan and the second scan, and the printing controller is configured to cause the plurality of nozzles to perform the bidirectional printing based on the image data in an area other than the area of the code information by performing printing by both of the first scan and the second scan.

* * * * *